US009860641B2

(12) United States Patent
Kyriakakis et al.

(10) Patent No.: US 9,860,641 B2
(45) Date of Patent: Jan. 2, 2018

(54) AUDIO OUTPUT DEVICE SPECIFIC AUDIO PROCESSING

(71) Applicants: Chris Kyriakakis, Altadena, CA (US); Kevin Dixon, Pasadena, CA (US); Tyson Osborne Yaberg, Camarillo, CA (US); Chandra Rajagopal, Los Angeles, CA (US)

(72) Inventors: Chris Kyriakakis, Altadena, CA (US); Kevin Dixon, Pasadena, CA (US); Tyson Osborne Yaberg, Camarillo, CA (US); Chandra Rajagopal, Los Angeles, CA (US)

(73) Assignee: Audyssey Laboratories, Inc., Los Angeles, CA (US)

( * ) Notice: Subject to any disclaimer, the term of this patent is extended or adjusted under 35 U.S.C. 154(b) by 47 days.

(21) Appl. No.: 14/603,162

(22) Filed: Jan. 22, 2015

(65) Prior Publication Data

US 2015/0156588 A1 Jun. 4, 2015

Related U.S. Application Data

(63) Continuation-in-part of application No. 14/094,323, filed on Dec. 2, 2013, now Pat. No. 9,312,830, and a (Continued)

(51) Int. Cl.

| | |
|---|---|
| ***H04R 3/04*** | (2006.01) |
| *H04R 1/10* | (2006.01) |
| *H04R 5/033* | (2006.01) |

(52) U.S. Cl.
CPC ..... *H04R 3/04* (2013.01); *H04R 1/1008* (2013.01); *H04R 5/033* (2013.01); (Continued)

(58) Field of Classification Search
CPC ..... H04R 3/04; H04R 1/1008; H04R 5/033; H04R 2227/003; H04R 2499/11; (Continued)

(56) References Cited

U.S. PATENT DOCUMENTS 8,675,130 B2 * 3/2014 Fincham ..... H04N 5/57 348/552
2001/0049566 A1 * 12/2001 Kim ..... H03G 3/3089 700/94

(Continued)

*Primary Examiner* — Jason R Kurr
(74) *Attorney, Agent, or Firm* — Kenneth L. Green; Averill & Green

(57) ABSTRACT

A source device uses a profile of an audio output device (e.g., headphones or speakers) to adjust the acoustic output of the audio output device. A database of audio output device profiles is stored in a cloud or locally on the source device. The profiles may include electroacoustic measurement data characterizing the audio output device or processing parameters for the audio output device. A program running on the source device selects a profile corresponding to the connected audio output device. The profile is used by the software running on the source device to determine processing for an audio stream played by the audio output device. The processing provides equalization to modify the unique audio output device frequency response, and compensation for human perception of sound at different listening levels, and dynamic range adjustment to better match the capabilities of the audio output device.

20 Claims, 4 Drawing Sheets

Related U.S. Application Data continuation-in-part of application No. 14/254,069, filed on Apr. 16, 2014, now Pat. No. 9,264,811.

(52) U.S. Cl.
CPC .... *H04R 2227/003* (2013.01); *H04R 2420/07* (2013.01); *H04R 2499/11* (2013.01); *H04R 2499/13* (2013.01); *H04R 2499/15* (2013.01)

(58) Field of Classification Search
CPC ..... H04R 2499/13; H04R 2499/15; H04R 2430/01; H04R 2430/03; H04R 2420/07; H03G 3/20; H03G 3/3005; H03G 5/00; H03G 5/025; H03G 5/16; H03G 5/165; H03G 7/00; H03G 7/002; H03G 9/00; H03G 9/025; H03G 11/00; H03G 11/04
USPC ..... 381/58, 98, 101, 102, 103, 104, 107, 74; 700/94
See application file for complete search history.

(56) References Cited

U.S. PATENT DOCUMENTS

| | | | | |
|---|---|---|---|---|
| 2007/0078546 | A1* | 4/2007 | Hsieh | H04R 3/04 700/94 |
| 2010/0215193 | A1* | 8/2010 | Wihardja | H04R 3/04 381/103 |
| 2011/0002471 | A1* | 1/2011 | Wihardja | H03G 5/005 381/56 |
| 2012/0063615 | A1* | 3/2012 | Crockett | G10L 21/0364 381/98 |
| 2014/0037108 | A1* | 2/2014 | Christoph | H03G 3/20 381/107 |
| 2014/0301567 | A1 | 10/2014 | Kim | |
| 2016/0036404 | A1* | 2/2016 | Fleischmann | H03G 5/165 381/103 |

* cited by examiner

AUDIO OUTPUT DEVICE SPECIFIC AUDIO PROCESSING

CROSS-REFERENCE TO RELATED APPLICATIONS

The present application is a Continuation In Part of U.S. patent application Ser. No. 14/094,323 filed Dec. 2, 2013, and a Continuation In Part of U.S. patent application Ser. No. 14/254,069 filed Apr. 16, 2014, which applications are incorporated in their entirety herein by reference.

BACKGROUND OF THE INVENTION

The present invention relates to audio processing and in particular to customizing audio streams on a source device based on a specific audio output device attached to the source device.

Known headphones, portable speakers, smartphone/tablet speakers, television speakers, soundbars, laptop speakers, and general audio playback devices have unique frequency responses and playback characteristics/limitations. The unique frequency responses of these audio outputs devices vary from device to device and also vary from frequency responses of reference systems used by professional audio engineers. As a result, the sound heard by a listener often is not an accurate reproduction of the original mixed reference sound.

BRIEF SUMMARY OF THE INVENTION

The present invention addresses the above and other needs by providing a source device which uses a profile of an audio output device (e.g., headphones or speakers) to adjust the acoustic output of the audio output device. A database of audio output device profiles is stored in a cloud or locally on the source device. The audio output device profiles may include electroacoustic measurement data characterizing the audio output device or processing parameters for the audio output device. When an audio output device is connected to the source device, a program running on the source device selects a profile from the database for the connected audio output device. The profile of the audio output device is used by the software running on the source device to determine processing for an audio stream played by the audio output device. The processing provides equalization to modify the unique audio output device frequency response, compensation for human perception of sound at different listening levels, and dynamic range adjustment to better match the capabilities of the audio output device.

In accordance with one aspect of the invention, algorithms are provided to process signals provided to various audio output devices so that the audio output devices produce consistent reference sound playback.

In accordance with another aspect of the invention, algorithms are provided to modify sounds produced by various audio output devices for a desired target sound (e.g. artist, or manufacturer signature sound). Examples of a target sound include artist or manufacturer signature sound, or the acoustic output of a target audio output device. In the case the target sound is the acoustic output of a target audio output device, the target sound may be achieved by applying an inverse frequency response of the audio output device times the frequency response of the target audio output device, to an audio stream.

In accordance with still another aspect of the invention, electroacoustic measurement data is generated for a number of audio output devices in a typical listening environment. In the case of headphones, the typical listening environment may be simulated using a Head and Torso Simulator (HATS). A HATS system provides a realistic reproduction of the acoustic properties of an average adult human head and torso, for example a Bruel & Kjaer 4128C HATS.

In accordance with yet another aspect of the invention, a database of electroacoustic measurements is created that characterizes the acoustic performance of a large variety of audio output devices. The audio output devices include: headphones; portable speakers; smartphone/tablet speakers; television speakers; soundbars; laptop speakers; car speakers; outdoor speakers; and the like. Several electroacoustic measurements are used to characterize the acoustic performance of each audio output device. Examples of the electroacoustic measurements include: frequency response; various forms of acoustic distortion measured at different volume levels; sensitivity; directivity; impedance; dynamic range; etc. The electroacoustic measurements for the audio output device are stored in a profile. The profile of a particular audio output device connected to the source device is retrieved and processing parameters are derived from the electroacoustic measurements stored in the profile for the particular audio output device.

In accordance with another aspect of the invention, a database of processing parameters is created for a large variety of audio output devices, for example, headphones, portable speakers, smartphone/tablet speakers, television speakers, soundbars, laptop speakers, car speakers, outdoor speakers, and the like. The processing parameters are determined based on several electroacoustic measurements which characterize the acoustic performance of each audio output device. Examples of processing parameters are the parameters used by each algorithm or filter running in the software on the source device to process an audio stream. The processing parameters may be Finite Impulse Response (FIR) or Infinite Impulse Response (IIR) filter coefficients, limiter parameters, thresholds, etc. Some examples of the electroacoustic measurements are: frequency response; various forms of acoustic distortion measured at different volume levels; sensitivity; directivity; impedance; dynamic range; etc. The processing parameters are stored, and a set of processing parameters for the audio output device connected to a source device is selected for use.

In accordance with still another aspect of the invention, software (installed applications or firmware) is provided which runs on a source device, for example, a smartphone, a tablet, a television, a laptop, and any device which is capable of processing an audio stream provided to an audio output device (for example, headphones or speakers) connected to the source device. The software running on the source device receives identification of the audio output device connected to the source device. A dialogue or interface may be presented to a user to allow the user to select the model of the audio output device, or the software may automatically detect which audio output device is connected to the source device. The automatic detection of the audio output device may be accomplished using several different methods, including, but not limited to, detecting the unique impedance of the audio output device, image recognition of the audio output device, scanning the UPC barcode on the audio output device or its packaging, Near Field Communication (NFC) signature, metadata transmitted from the audio output device when it is connected to the source device, and the like. Once the model of the audio output device is known by the software, the software accesses the database of profiles and downloads a profile which characterizes the acoustic output of the respective audio output device. The software then uses the profile to determine processing to customize the audio stream being sent to the audio output device.

In accordance with another aspect of the invention, source device software is provided which applies equalization and dynamic audio processing. The source device processes an audio stream from a local file or remote audio streams being played through the source device, and the processed signal is provided to an audio output device. An example of dynamic audio processing is perceptual loudness compensation developed by Audyssey Laboratories, Inc. The perceptual loudness compensation processing applies additional equalization (dependent on the source device playback level) to address a psychoacoustic phenomenon, that shifts perceived balance of high and low frequencies at different playback levels.

In accordance with yet another aspect of the invention, an audio output device profile is provided to a source device. The audio output device profile may include one or more processing parameters specific to an audio output device connected to the source device, the processing parameters including:

- a set of equalization Finite Impulse Response (FIR) filter coefficients (for all supported sampling rates) to compensate for an audio output device frequency response to obtain a desired frequency response corresponding to a reference sound or a target sound. A profile for a specific audio output device may include several unique FIR filter sets, each corresponding to different playback volume levels of the audio output device;
- audio output device voltage sensitivity, used to calibrate dynamic range control and perceptual loudness compensation;
- audio output device limiter parameters (such as attack time, release time, threshold, knee, number of bands, lookahead time, and frequencies covered by those limiter bands);
- an amount of gain that must be applied when enabling equalization in order to match the loudness of the processed and un-processed audio produced by the audio output device, this gain is applied to the audio stream in the limiter stage;
- headphone externalization parameters;
- volume curve adjustment for signal processing headroom;
- equalization correction for source device impedance and audio output device impedance interactions;
- FFT bin based signal processing limitations;
- flags to indicate whether individual audio processing technologies should be enabled or not for the audio output device; and
- audio output device identification metadata, for example, name, model, brand, pictures, supported audio output routes, etc.

In accordance with another aspect of the invention, acoustic distortion is reduced in an audio output device. Limiter settings in a source device are set based on the distortion limits of the audio output device. Further, frequency dependent distortion limits of an audio output device may be considered in equalization processing to allow reducing levels in bands which saturate at lower levels while allowing other bands to reach higher levels when a higher overall sound level is desired.

In accordance with still another aspect of the invention, a method for characterizing an audio output device is provided. The method includes creating profiles for M audio output devices, storing the M profiles, connecting a source device to an Nth audio output device, selecting the Nth profile of the Nth audio output device, obtaining processing parameters based on the Nth profile, processing a source device signal using the selected processing parameters, providing the processed signal to the audio output device.

In accordance with yet another aspect of the invention, a method for processing an audio stream is provided. The method includes performing headphone externalization, performing dynamic range control, performing perceptual loudness compensation processing, performing EQ correction for source device and audio output device impedance interactions, applying audio output device equalization, applying tonal balance processing, applying FFT bin based signal limiting, and applying limiter processing. A loudness-matching gain specific to the audio output device is selected and provided to the limiter processing. The equalization may be FIR or IIR equalization and the processing can run at the application layer of the source device or the firmware layer of the source device.

In accordance with another aspect of the invention, a method for performing EQ correction for source device and audio output device impedance interactions in either the cloud or in the source device is provided. The source device impedance may be provided to the cloud, and profiles stored in the cloud may be customized based on the source device impedance and audio output device impedance combination. Alternatively, the impedance of the audio output device may be stored in the audio output device profile as part of the electroacoustic measurement data and may be provided to the source device, and software running on the source device may compensate for the impedance interaction between the source device and audio output device when processing the audio stream.

In accordance with yet another aspect of the invention, a method for creating the equalization filters in a source device based on an audio output device profile is provided. The derivation of equalization filters is described in U.S. Pat. Nos. 7,567,675; 7,769,183; 8,005,228; and 8,077,880, incorporated in their entirety herein by reference. The equalization filters are created to correct the acoustic output of the audio output device to achieve the desired sound. The derivation of the equalization filters may occur after generation of the electroacoustic measurement data and then the equalization filters may be stored in a profile containing processing parameters.

In accordance with another aspect of the invention, a method for determining an audio output device connected to a source device using impedance measurements is provided. The method includes connecting the audio output device to the analog output of the source device, the source device detecting that the audio output device has been connected, providing an analog test signal from the source device to the audio output device, measuring voltage and current of the test signal sent to the audio output device by the source device, calculating impedance of the audio output device from the measured voltage and current, generating impedance metrics from the calculated impedance, comparing the impedance metrics to a database of impedance metrics for a multiplicity of audio output devices, selecting the audio output device having the best match to the impedance metrics, and using the audio output device profile of the selected audio output device to process an audio steam. The step of comparing the impedance metrics to a database of impedance metrics for a multiplicity of audio output devices may be performed in the source device when the audio output device database resides in the source device, and the comparing may be performed in a cloud when the database is stored in the cloud.

In accordance with still another aspect of the invention, an encrypted audio output device profile is provided to the source device. The encrypted audio output device profile is decrypted in the source device for use.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
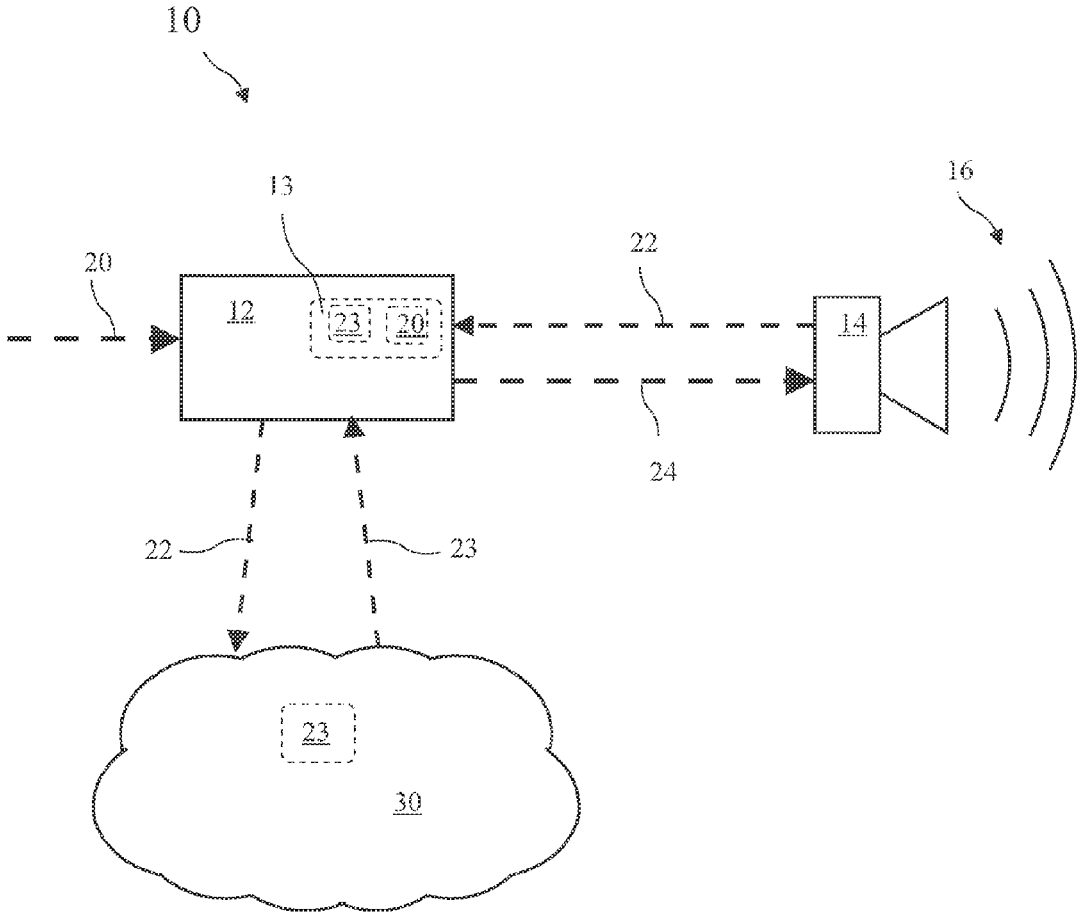
FIG. 1 shows a source device connected to an audio output device according to the present invention.

An audio system 10 including source device 12 connected to an audio output device 14 according to the present invention is shown in FIG. 1. The source device 12 may contain memory 13 containing an audio stream 20 or may receive the audio stream 20 from an external source. The audio output device 14 may be electrically connected by electrically conductive wires to the source device 12 and receive an analog or digital processed audio stream 24 from the source device 12, or may be wirelessly connected to the source device 12 and receive the digital processed audio stream 24 from the source device 12. The audio output device 14 transduces the electrical signals into sound waves 16 heard by a user. The audio output device 14 may be any of headphones, portable speakers, smartphone/tablet speakers, television speakers, soundbars, laptop speakers, car speakers, outdoor speakers, and may be any transducer converting an electrical signal to sound waves.

The source device 12 further processes the audio stream 20 to produce the processed audio stream 24. When automatic audio output device detections occurs, the audio output device 14 provides an audio output device identification 22 to the source device 12 identifying the audio output device 14, or some other automatic audio output device identification is performed. When manual detection is exercised, a dialog or other user interface in presented to the user, and the user selects the audio output device 14 connected to the source device 12 from a list of audio output devices.

A number M audio output device profiles 23 are previously generated and saved in a database. The audio output device profiles 23 may include raw electroacoustic measurement data which support determining processing parameters for the audio output device 14, or may be the processing parameters for the audio output device 14. The raw audio output device 14 electroacoustic measurement data may include, for example, frequency response, sensitivity, impedance, various forms of acoustic distortion measured at different volume levels, directivity, dynamic range, etc., which characterize the acoustic performance of the audio output device 14. The impedances of the audio output devices may also be included in the raw data.

The automatic audio output device 14 identification may include one of several different methods, including, but not limited to, detecting the unique impedance of the audio output device, image recognition of the audio output device, scanning the UPC barcode on the audio output device or its packaging, Near Field Communication (NFC) signature, Bluetooth pairing data, metadata transmitted from the audio output device when it is connected to the source device, and the like.

The M audio output device profiles 23 may be stored in the memory 13 of the source device 12, or remotely, for example, in a cloud 30. The source device 12 may directly map the device identification 22 into a matching audio output device profile 23, and when the audio output device profiles 23 are stored in cloud 30, the source device 12 may forward the device identification 22 to the cloud 30, and the cloud 30 provides the corresponding audio output device profile 23 to the source device 12. After identifying the audio output device profile for the audio output device 14 presently connected to the source device 12, appropriate corrections for the audio stream 20 may be determined, for example, appropriate equalization may be determined.

Figure 2:
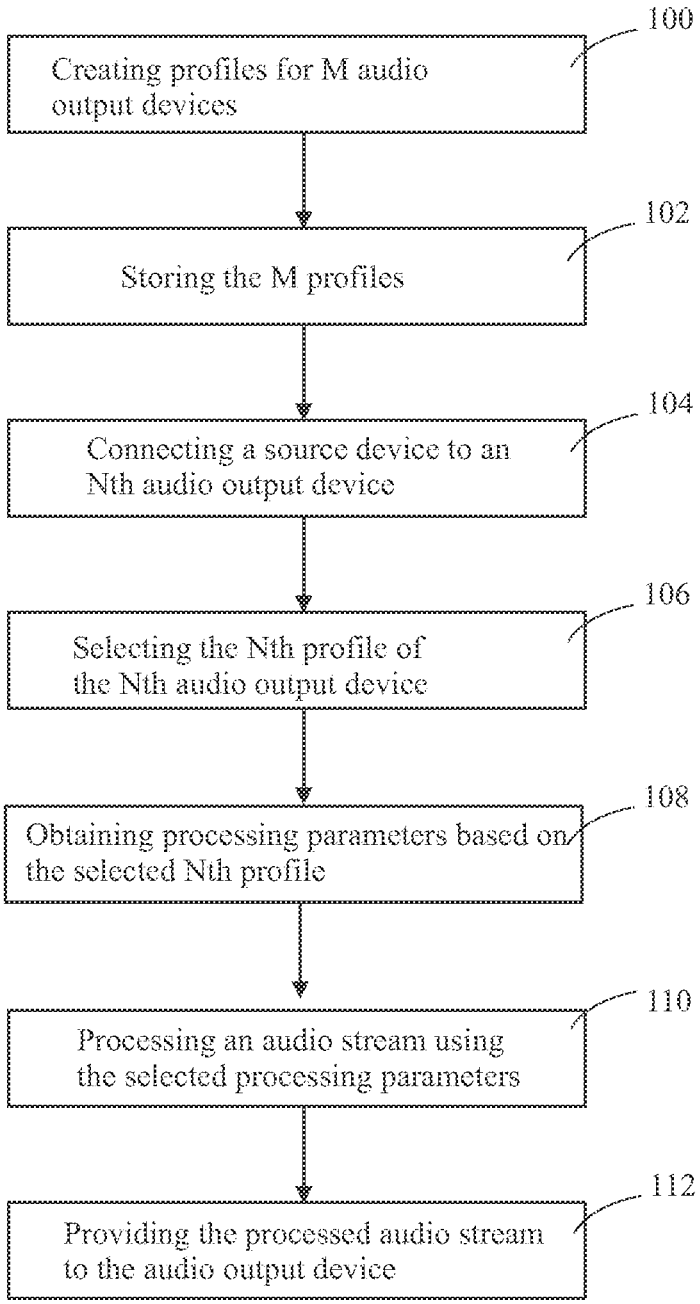
FIG. 2 shows a method for characterizing the audio output device and processing an audio stream in the source device for the audio output device based on the audio output device profile according to the present invention.

A method for characterizing the audio output device 14 and processing the audio stream 20 in the source device 12 for the audio output device 14 based on the audio output device profile 23 is described in FIG. 2. The method includes creating profiles for M audio output devices in step 100, storing the M profiles in step 102, connecting a source device to an Nth audio output device in step 104, selecting the Nth profile of the Nth audio output device at step 106, obtaining processing parameters based on the Nth profile at step 108, processing an audio stream using the selected processing parameters in step 110, providing the processed audio stream to the audio output device at step 112.

Creating profiles in step 100 may include computing and storing processing parameters derived from raw audio output device electroacoustic measurements, and/or the profiles may include the raw audio output device electroacoustic measurement data. Obtaining processing parameters in step 108 may include computing the processing parameters from the raw audio output device electroacoustic measurement data. Selecting the Nth profile of the Nth audio output device at step 106 may comprise requesting and obtaining the Nth profile from an external device, for example the cloud 30, or from a database stored in the source device 12. The Nth profile may be stored, remotely or locally, in an encrypted form and decrypted for use to protect any proprietary information in the Nth profile developed for the Nth audio output device, against software piracy.

Figure 3:
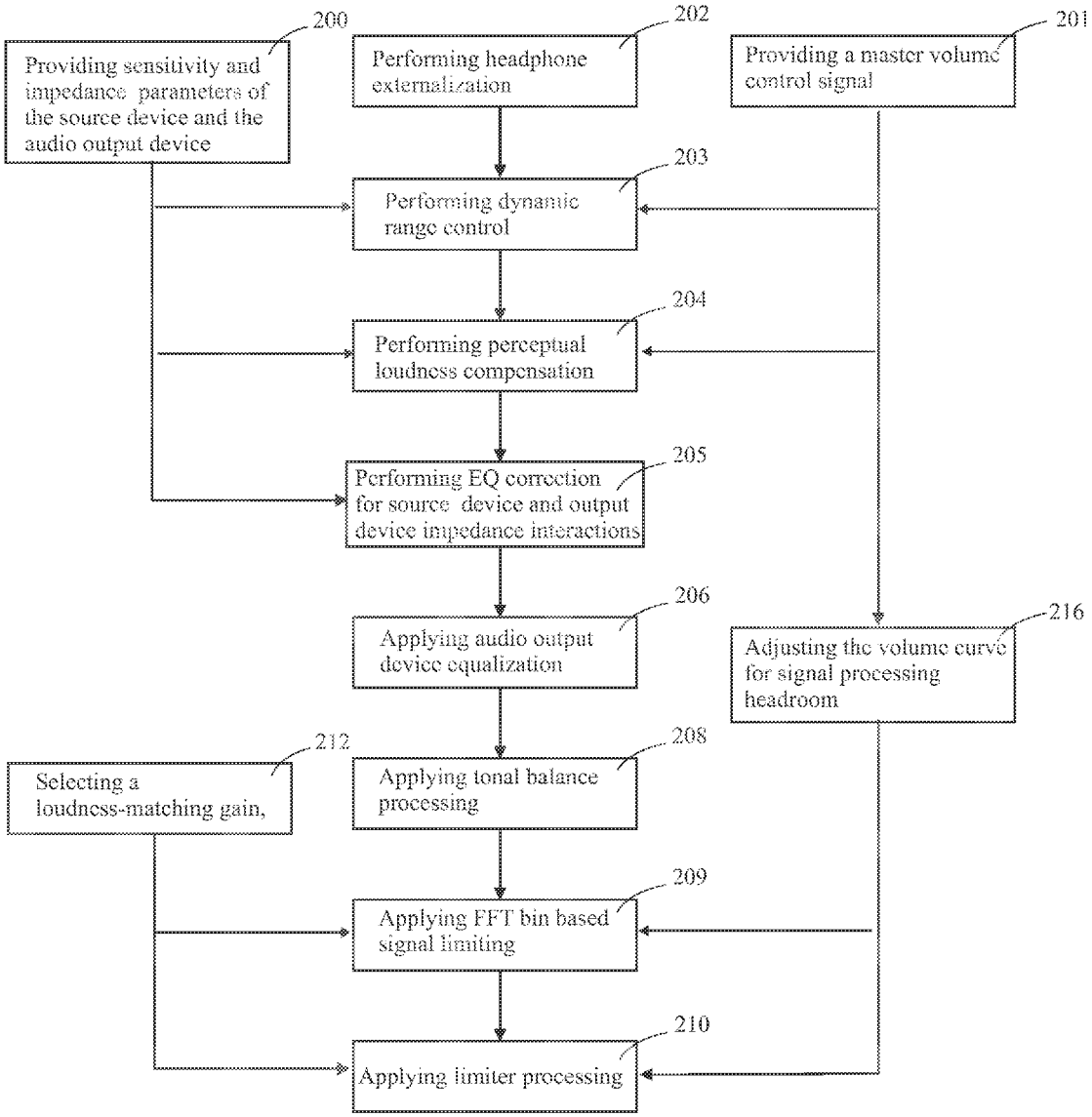
FIG. 3 shows a method according to the present invention for processing the audio stream in the source device.

A method for processing the audio stream 20 in the source device 12 is described in FIG. 3. The method includes providing sensitivity and impedance parameters of the source device and the audio output device in step 200, providing a master volume in step 201, performing headphone externalization in step 202, performing dynamic range control in step 203, performing perceptual loudness compensation processing in step 204, performing EQ correction for source device and audio output device impedance interactions in step 205, applying audio output device equalization in step 206, applying tonal balance processing in step 208, applying FFT bin based signal limiting in step 209, and applying limiter processing in step 210.

The sensitivity and impedance parameters of the source device and the audio output device provided in step 200 are provided to steps 203, 204, and 205. The master volume control signal provided in step 201 is provided to steps 203 and 204, and to adjusting a volume curve for signal processing headroom in step 216. The adjusted volume curve from step 216 is provided to steps 209 and 210. A loudness-matching gain specific to the audio output device is selected in Step 212 and provided to steps 209 and 210.

The FFT bin based signal limiting in step 209 is described in U.S. patent application Ser. No. 13/230,686 filed Sep. 12, 2011 incorporated herein by reference above. The adjusting the volume curve for signal processing headroom in step 216 is described in U.S. patent application Ser. No. 14/094,323 filed Dec. 2, 2013, and was incorporated above by reference above. The performing EQ correction for source device and audio output device impedance interactions in step 205 is described in U.S. patent application Ser. No. 14/254,069 filed Apr. 16, 2014, and was incorporated above by reference above.

The step 202 of performing headphone externalization expands the soundstage of headphones beyond the headphone's restricted soundstage, for example to simulate the experience of listening to speakers placed in a room.

The step 206 of applying equalization may include providing a plurality of FIR or IIR filter sets, each set corresponding to a playback volume level and the equalization processing may run at the application layer of the source device or the firmware layer of the source device. The FIR or IIR filter set associated with a volume level closest to the present playback volume level may be selected, or an FIR or IIR filter set may be obtained by interpolating between the FIR or IIR filter sets associated with nearest volume levels above and below the present playback volume level. Alternatively, IIR filters may replace or augment the FIR filter sets. In the case the target sound is the acoustic output of a target audio output device, the following equalization may be applied to the audio stream:

$$Y=A_\text{inv}*B*X$$

Where,

X=audio stream

Y=processed audio stream

A=frequency response of the audio output device

B=frequency response of the target audio output device

A_inv=inverse frequency response of A, where A*A_inv=1 (flat frequency response)

A method for automatic audio output device detection may receive the measured impedance of the audio output device 14 and compare that impedance against a database of known audio output device impedance metrics to automatically detect what audio output device 14 is connected to the source device 12. The database of impedances of audio output devices can be stored locally on the source device 12 or in a cloud-based database. In addition, this database of impedance metrics can be dynamic.

Figure 4:
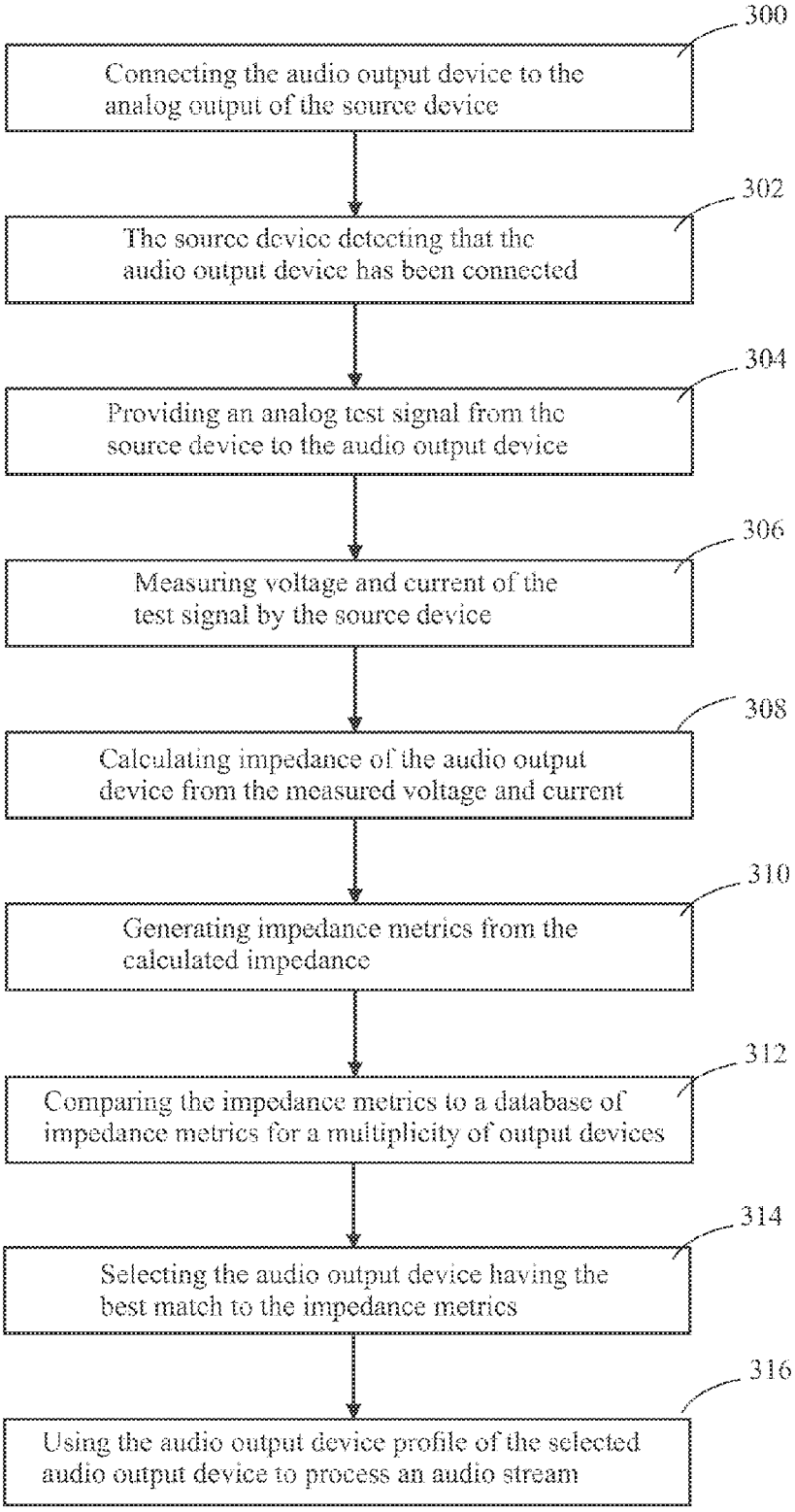
FIG. 4 shows a method for determining an audio output device connected to a source device using impedance measurements, according to the present invention.

An example of a method for determining an audio output device 14 connected to a source device 12 using impedance measurements is shown in FIG. 4. The method includes connecting the audio output device to the analog output of the source device at step 300, the source device detecting that the audio output device has been connected at step 302, providing an analog test signal from the source device to the audio output device at step 304, measuring voltage and current of the test signal by the source device at step 306, calculating impedance of the audio output device from the measured voltage and current at step 308, generating impedance metrics from the calculated impedance at step 310, comparing the impedance metrics to a database of impedance metrics for a multiplicity of audio output devices at step 312, selecting the audio output device having the best match to the impedance metrics at step 314, and using the audio output device profile of the selected audio output device to process an output signal at step 316. The step 312 of comparing the impedance metrics to the database of impedance metrics for a multiplicity of audio output devices may be performed in the source device when the database resides in the source device, or the comparing may be performed in a cloud when the database is stored in the cloud.

Comparing the impedance metrics to the database of impedance metrics for a multiplicity of audio output devices at step 312 may include, but is not limited to, comparing impedance magnitude and phase, comparing the variation of impedance magnitude and phase vs. frequency, and comparing impedance values between different terminals of an audio output device (for instance the Left and Right speaker terminals of a headphone).

The method of FIG. 4 may determine which impedance in the database is the closest match to the measured impedance of the audio output device. The extent of certainty for the match (i.e. how close the match is) may also be determined and there are several methods for determining which impedance curve in the database is the closest matching to the measured impedance of the audio output device. These could include: correlation between impedance vs. frequency curves, mean absolute error between those curves, and correlation between Left and Right speaker measurements (for a headphone, for instance). The database of impedance metrics may be dynamic. When the present invention is implemented in a consumer-facing device, user feedback may be used to better inform the headphone model selection algorithm. User feedback could also result in other statistical metrics that can be used to improve the headphone model selection algorithm.

While the invention herein disclosed has been described by means of specific embodiments and applications thereof, numerous modifications and variations could be made thereto by those skilled in the art without departing from the scope of the invention set forth in the claims.

We claim:

1. A method for providing customized sound reproduction, comprising:

characterizing M audio output devices to obtain M profiles;

storing the M profiles;

providing a source device;

connecting the source device to an Nth audio output device;

selecting an Nth profile of the Nth audio output device;

processing an audio stream based on the selected profile to produce a processed audio stream including performing perceptual loudness compensation processing applying additional equalization dependent on the source device playback level to address a psychoacoustic phenomenon, the additional equalization shifts a balance of high and low frequencies at different playback levels;

providing the processed audio stream to the audio output device; and transducing the processed audio stream in the audio output device to produce sound waves, wherein:

processing the audio stream based on the selected profile further includes performing equalization and applying limiter processing; and performing equalization comprises:

obtaining a plurality of filter coefficients sets, each filter coefficients set comprising a plurality of filter coefficients, the filter coefficients sets having audio levels:

selecting a lower filter coefficients set, comprising the audio level of the lower filter coefficients set the highest of the audio levels below a user audio level;

selecting a higher filter coefficients set, comprising the audio level of the higher filter coefficients set the lowest of the audio levels above the user audio level; and obtaining an equalization filter set by interpolating between first filter coefficients of the lower filter coefficients set and second filter coefficients of the higher filter coefficients set, the first and second filter coefficients comprising Finite Impulse Response (FIR) filter coefficients or Infinite Impulse Response (IIR) filter coefficients.

2. The method of claim 1, further including a step of performing dynamic range control based on audio output device voltage sensitivity and a master volume control signal.

3. The method of claim 1, further including applying tonal balance processing after performing equalization and before applying limiter processing.

4. The method of claim 1, wherein performing equalization comprises performing headphone equalization processing.

5. The method of claim 1 wherein performing equalization comprises applying Finite Impulse Response (FIR) filter equalization.

6. The method of claim 1, wherein performing equalization comprises applying Infinite Impulse Response (IIR) filter equalization.

7. The method of claim 1, wherein performing equalization includes performing equalization using a profile selected from the stored profiles, the selected profile including at least one of:

filter sets used to compensate for an audio output device frequency response to obtain a desired frequency response corresponding to a reference sound or a target sound, for all supported sampling rates and playback volume levels;

audio output device and source device voltage sensitivities to properly calibrate dynamic range control and perceptual loudness compensation;

audio output device and source device impedance data to perform equalization correction for audio output device and source device impedance interaction;

audio output device limiter parameters including at least one of:

attack time;

release time;

threshold;

knee;

number of bands;

lookahead time; and frequencies covered by limiter bands;

an amount of gain applied to the audio stream in the limiter stage that must be applied when performing equalization in order to match the loudness of the processed and un-processed audio produced by the audio output device;

flags to indicate whether individual audio processing technologies should be enabled or not for the audio output device; and audio output device identification metadata including at least one of:

name;

model;

brand;

pictures; and supported output audio route.

8. The method of claim 1, further including:

encrypting the M audio output device profiles;

providing the encrypted M audio output device profiles to the source device; and decrypting the encrypted M audio output device profiles in the source device for use.

9. The method of claim 1, wherein applying limiter processing comprises setting limiter settings based on distortion limits of the audio output device.

10. The method of claim 9, wherein setting limiter settings based on distortion limits of the audio output device includes considering frequency dependent distortion limits of the audio output device in equalization processing to allow reducing levels in first equalization bands which saturate at lower levels while allowing second equalization bands to reach higher levels when a higher overall sound level is desired.

11. The method of claim 1, further including performing Fast Fourier Transformation (FFT) bin based signal limiting before applying limiter processing.

12. The method of claim 1, wherein selecting the Nth profile of the Nth audio output device includes first identifying the Nth audio output device.

13. The method of claim 12, wherein identifying the Nth audio output device comprises at least one of:

presenting dialogue to a user to allow the user to select the model of the audio output device;

presenting an interface to a user to allow the user to select the model of the audio output device; and software automatically detecting which audio output device is connected to the source device.

14. The method of claim 13, wherein software automatically detecting which audio output device is connected to the source device comprises at least one of:

detecting the unique impedance of the audio output device;

recognizing an image of the audio output device;

scanning a device UPC barcode on the audio output device;

scanning a packaging UPC barcode on audio output device packaging;

detecting a Near Field Communication (NFC) signature;

using Bluetooth pairing data; and transmitting metadata from the audio output device to the source device.

15. The method of claim 14, wherein software automatically detecting which audio output device is connected to the source device comprises:

connecting the audio output device to an analog output of the source device;

the source device detecting that the audio output device has been connected;

providing an analog test signal from the source device to the audio output device;

measuring voltage and current of the test signal by the source device;

calculating impedance of the audio output device from the measured voltage and current;

generating impedance metrics from the calculated impedance;

comparing the impedance metrics to an audio output device database;

selecting the audio output device having the best match to the impedance metrics; and using the audio output device profile of the selected audio output device to process the audio stream.

16. The method of claim 1, wherein the M profiles comprise electroacoustic measurement data characterizing the audio output device.

17. The method of claim 16, wherein the M profiles comprise processing parameters specific to the audio output device.

18. A method for providing customized sound reproduction, comprising:

characterizing M audio output devices to obtain M profiles;

storing the M profiles;

providing a source device;

connecting the source device to an Nth audio output device;

selecting an Nth profile of the M profiles of the Nth audio output device of the M audio output devices;

selecting a user audio level for use in the Nth audio output device;

obtaining at least two filter sets, each filter set associated with the Nth profile and each of the filter sets associated with corresponding audio levels comprising audio levels below the user audio level and audio levels above the user audio level;

selecting a first filter set and second filter set from the at least two filter sets, wherein a first audio level associated with the first filter set is closest to the user audio level of the audio levels below the user audio level, and a second audio level associated with the second filter set is closest to the user audio level of the audio levels above the user audio level;

interpolating between first coefficients of the first filter set and second coefficients of the second filter set to obtain an interpolated filter coefficient set, the first and second coefficients comprising Finite Impulse Response (FIR) filter coefficients or Infinite Impulse Response (IIR) filter coefficients;

processing an audio stream based on the Nth profile and using the interpolated filter coefficient set to produce a processed audio stream;

providing the processed audio stream to the audio output device; and transducing the processed audio stream in the audio output device to produce sound waves.

19. A method for providing customized sound reproduction, comprising:

characterizing M audio output devices to obtain M profiles;

storing the M profiles;

providing a source device;

connecting the source device to an Nth audio output device;

selecting an Nth profile of the Nth audio output device;

determining a user audio level;

selecting processing, comprising:

obtaining a plurality of filter sets, each filter set comprising a plurality of filter coefficients, the filter sets having audio levels;

selecting a lower filter set, comprising the audio level of the lower filter set the highest of the audio levels below the user audio level;

selecting a higher filter set, comprising the audio level of the higher filter set the lowest of the audio levels above the user audio level; and interpolating between the lower filter set and the higher filter set to obtain the selected processing;

processing an audio stream using the selected processing to produce a processed audio stream including;

providing the processed audio stream to the audio output device; and transducing the processed audio stream in the audio output device to produce sound waves.

20. The method of claim 19, wherein the filter set comprise Finite Impulse Response (FIR) filter coefficients or Infinite Impulse Response (IIR) filter coefficients.

* * * * *